US005803156A

United States Patent [19]

Beckwith et al.

[11] Patent Number: 5,803,156

[45] Date of Patent: Sep. 8, 1998

[54] METHOD OF MAKING CATALYST CURED RESIN-COATED SAND CORES

[75] Inventors: Elaine Cecilia Beckwith, Northville; Thomas John Korniski, Livonia; James Stewart Rankin, II, Novi, all of Mich.

[73] Assignee: Ford Global Technologies, Inc., Dearborn, Mich.

[21] Appl. No.: 727,157

[22] Filed: Oct. 7, 1996

[51] Int. Cl.[6] ..... B22C 9/12

[52] U.S. Cl. ..... 164/456; 164/16; 164/159

[58] Field of Search ..... 164/456, 16, 159

[56] References Cited

U.S. PATENT DOCUMENTS

| | | | |
|---|---|---|---|
| 4,112,515 | 9/1978 | Sandow | 164/456 X |
| 4,132,260 | 1/1979 | Luber | 164/16 |
| 4,359,082 | 11/1982 | Michel | 164/16 |
| 4,912,332 | 3/1990 | Siebel et al. . | |
| 4,915,160 | 4/1990 | Reynolds | 164/456 |
| 5,135,043 | 8/1992 | Drake . | |
| 5,325,909 | 7/1994 | Unterderweide | 164/456 |
| 5,354,788 | 10/1994 | Johnson et al. . | |

FOREIGN PATENT DOCUMENTS

| | | | |
|---|---|---|---|
| 2437894 | 6/1980 | France | 164/16 |
| 2162137 | 6/1973 | Germany | 164/16 |
| 4112701 | 10/1992 | Germany | 164/5 |

*Primary Examiner*—J. Reed Batten, Jr.
*Attorney, Agent, or Firm*—Joseph W. Malleck

[57] ABSTRACT

A resin coated sand is blown into a core box to form an uncured core with a desired packing density. The core box has one or more inlets to permit ingress of gases and one or more outlets to permit egress of only gases. A non-catalyzing gas is passed through the defined sand core in the core box to create a first effluent and the hydrocarbon content in such first effluent that was exposed to the uncured resin of the sand core is measured. A catalyst carrying gas (nitrogen) is injected into the inlets to pass through the defined sand core within the core box for polymerizing the resin and thence exit from the outlets as a second effluent. The hydrocarbon content of the second effluent is continuously measured (i.e. non-dispersive infrared spectroscopy system). When the hydrocarbon content decreases to approximately the hydrocarbon content of the first effluent, the core box is opened to remove the sand core in a consistently cured condition.

6 Claims, 2 Drawing Sheets

METHOD OF MAKING CATALYST CURED RESIN-COATED SAND CORES

TECHNICAL FIELD

This invention relates to the technology of making resin-coated sand cores useful in making metal castings, and more particularly to technology that shortens the cycle time for making catalyst cured sand cores without loss of quality.

DISCUSSION OF THE PRIOR ART

The cold box process of making bonded sand cores is well known and uses a gas or vaporized catalyst to cure the resin-coated sand while the catalyst is in contact with the sand at room temperature. It remains a problem how to determine whether a consistent and high concentration of the catalyst has allowed the different parts of the resin to react within the closed core box. Without precise knowledge of the catalyst concentration, which may vary with time, an operator cannot know precisely when to open the core box, thereby risking not only exposure of the operator to noxious catalyst gases if the resin has not been properly cured, or risking an improperly bonded sand core and thus leading to high rates of scrap.

To applicants' knowledge, there is no known method to detect, measure and monitor the concentration of the catalyst in the core box in real time and no attempt has been made by the prior art to monitor the catalyst concentration in the core box effluent in real time. The operator either must err on the side of excess cycle time to fully insure that the catalyst has completed its curing job even at low unintended concentrations. As a result, shortened cycle times are not possible for the cold box process.

Certainly batch techniques which, over a long period of time, gather a detectable gas sample and which take an even longer period of time to analyze the sample by use of wet chemicals requiring titration, cannot give information that would aid in shortening the cycle time of core box usage. Most assuredly, other prior art techniques of monitoring the total mass of gas at the inlet to the core box, fail to enable an understanding of what part of the effluent is due to resin reaction, and therefore there is no knowledge in real time as to what is happening within the cold box core process.

SUMMARY OF THE INVENTION

It is an object of this invention to provide real time information as to constituent elements of core box gas effluent to assist in precisely determining the state of curing within the core box and thus eliminate the need to delay sand core removal beyond that precisely necessary for a totally bonded core.

The invention herein that meets such object is a method of making catalyst cured resin-coated sand cores wherein the resin coated sand has been blown into a core box to define an uncured core with a desired packing density, the core box having one or more inlets to permit ingress of gases and one or more outlets to permit egress of only gases. The method comprises (a) passing a non-catalyzing gas through the defined sand core in the core box to create a first effluent and measuring the hydrocarbon content in such first effluent that was exposed to the uncured resin of the sand core; (b) injecting a catalyst carrying gas into the inlets to pass through the defined sand core within the core box for polymerizing the resin and thence exit from the outlets as a second effluent; and (c) continuously measuring the hydrocarbon content of the second effluent and when the hydrocarbon concentration decreases to approximately the hydrocarbon content of the first effluent, opening the core box to remove the sand core in a consistently cured condition.

DETAILED DESCRIPTION AND BEST MODE

Figure 1:
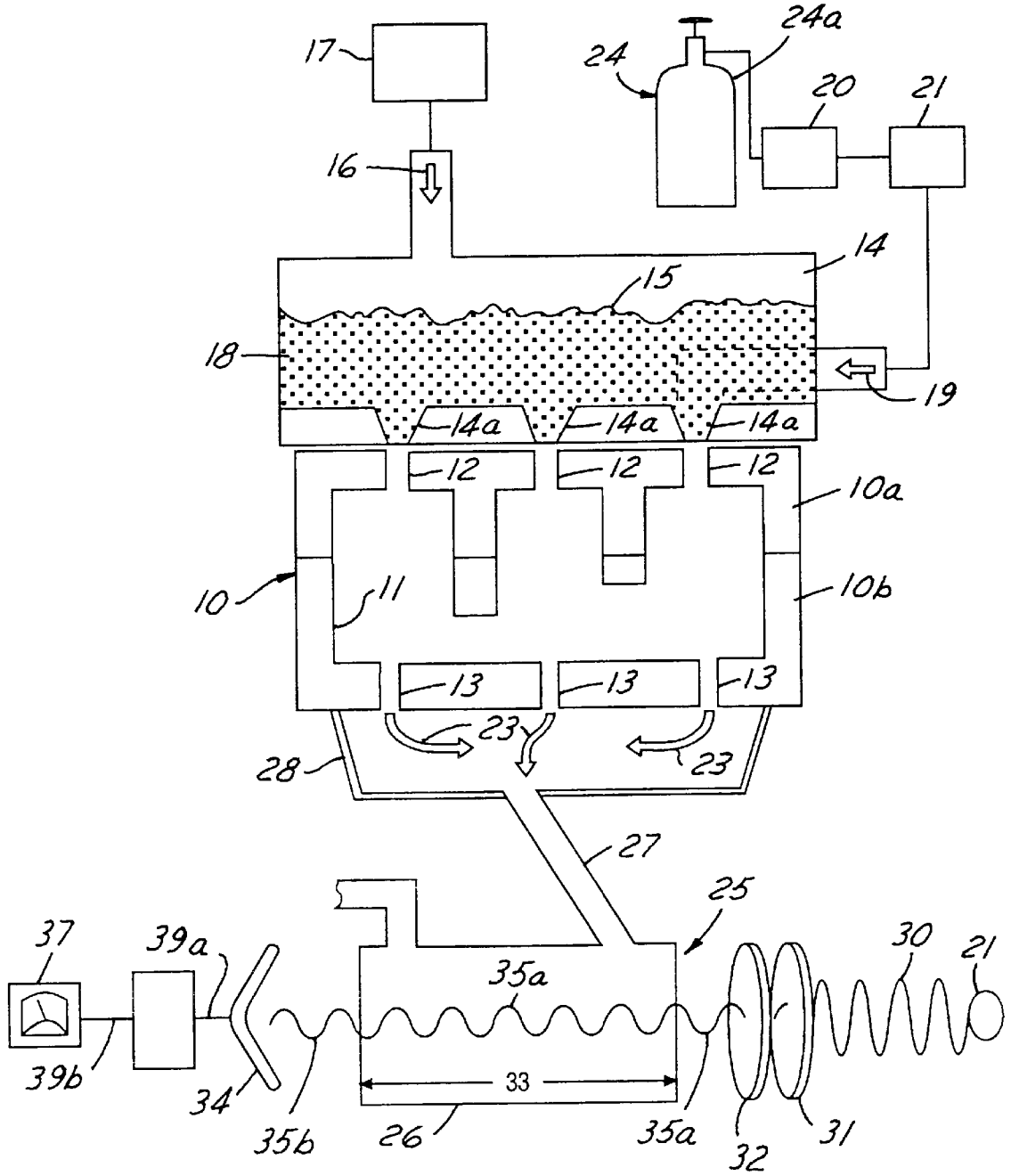
FIG. 1 is a schematic diagram of apparatus used in the cold core box process and including continuously connected non-dispersive infrared spectroscopy system equipment for detecting constituents of the gas effluent from the core box.

The cold box process is a generic term describing any binder process that uses a gas or vapor catalyst to cure resin-coated sand while it is in contact with a compacted sand pattern or core that is at room temperature. The cold box process consists of four main steps: sand blowing, gassing, purging and core removal. As shown in FIG. 1, a core box 10 (having upper and lower box portions 10*a* and 10*b*) defines an internal cavity 11 with one or more small inlets 12 and one or more screened outlets 13. To effect sand blowing, a fluidizing chamber or sand magazine 14 is placed on top of the core box and has conically shaped portions 14*a* in communication with each inlet 12 to the core box. Resin-coated sand 18, in a predetermined volume, is introduced to the chamber 14 to a level 15, such as illustrated; a supply of fluidizing gas 16, such as pressurized air at about 80 psi from a supply 17, is admitted into the chamber 14 to create an air/sand suspension which thence flows into the inlets 12, packing the cavity 11 with the sand mixture while the fluidizing gas migrates through the sand to exit through the screened outlets 13. The core forming sand is usually silicon lake sand with an average particle size from 200 to 300 microns. Zircon sand can be used also. Generally, the core forming sand has a particle size in the range of 10 to 600 microns, to provide a packing density that is usually about 1.7 g/cc. Such sand type facilitates being coated with a resin to create an optimum urethane bond between the sand particles. The resin preferably is a liquid phenolic carried in a solvent, the phenolic having separate hydroxyl and polyisocyanate functionality which react in the presence of an amine catalyst (i.e., triethylamine) to produce a solid binder as urethane. Other binders may include furan resins, epoxy resins, and polyesters, all of which depend upon hydrocarbon bonds, oxygen-carbon bonds or nitrogen-carbon bonds when cured. The sand is coated with such liquid resin by being combined and mixed in a mixing device to form the homogeneously coated sand collection 18.

The gassing step is effected by stopping the flow of fluidizing air 16, removing the fluidizing chambers or sand magazine 14 from atop the core box which has now been packed with sand, and placing a catalyst gas purging apparatus 24 in communication with the inlets 12. Pressurized amine catalyst gas 19 is released from a supply 24 a by operation of shut-off valve 20 and regulation of the pressure of the amine gas is carried out by way of pressure regulator 21 to a pressure of about 20 psi. The curing gas migrates through the interstices (porosity) of the defined sand core to eventually exit from outlets 13 as an effluent 23. Although the mass of gas needed to cure the resin binder can be readily determined using stoichiometric data, an operator is never completely certain such determined mass is sufficiently high enough in concentration for the given geometry of the core and outlet sizing, as well as the outlet placement, to permit the curing gas to fully due its job; outlet sizing permits part of the curing gas to escape during curing and must be compensated. The amount of curing gas lost during curing is also dependent upon the integrity of the sealing of the core box parts; often undergasing or over-gassing occurs. It is typical to inject about 1.7 weight % amine gas into the carrier gas, such as nitrogen, which nitrogen is flowing at a rate of about 9–10 liters per minute.

After the curing is theoretically completed, and before the core box can or should be opened, the amine gas purges through the defined core; given enough time, gases in the core box, as well as the effluent from the core box, eventually return to a harmless background level of hydrocarbon or amine. However, knowledge, in real time, of the content and rate of change in the chemical constituents of the effluent would be determinative in deciding when to cease purging and to open the core box for removal of the completely bonded sand core.

This real time knowledge is obtained with the use of a non-dispersive infrared analysis system 25 which has a gas sample cell 26 communicating by way of passage 27 with an exit manifold 28 that collects the effluent 23 from the various outlets 13. An infrared light source 29 is focused to direct a beam 30 of infrared light through a pair of infrared light filters 31, 32 before the filtered beam 35*a* traverses though the interior length 33 of the cell 26. The filter 31 passes infrared light having a wave length range between 3.25 microns and 3.5 microns, corresponding to the wave length of hydrocarbons of amine which will absorb such passed light, and filter 32 passes infrared light in the wave length range of 8–10 microns corresponding to the wave length of nitrogen-carbon bonds of the amine which will absorb such passed light. An infrared sensor 34 (a thermopile) continuously converts light 35*b* into a voltage signal 39*a* that is related to amine concentration. Means 36 is used to provide a concentration signal 39*b* by calibration. Such amine concentration signal 39*b* is displayed on a meter 37, and a real-time running layout of such amine concentration can be recorded in graphical form such as shown in FIG. 2.

The filtered light 35*a* is exposed to the effluent in the cell; any unreacted phenolic resin will possess nitrogen-carbon bonds and hydrocarbon bonds which absorb the light passing therethrough. To the degree the effluent still carries unreacted phenolic resin and unreacted polyisocyanate, the passed infrared light 35*a* in the cell will be absorbed and the net sensed infrared light energy 39*a* will be proportional to the presence of the amine catalyst which has not completed its job or is not present in sufficient concentration. The analysis system 25 thus continuously measures the remaining hydrocarbon and amine concentration in the gas stream 23.

To make the real time measurements meaningful, the system 25 must first be operated to determine background and uncured resin content in the effluent. As shown in FIG. 2, data was collected for one example using this invention. The sand used in the core forming process was coated with 1.7 wt % isocyanate/phenol resin system by stirring the constituents in a mixer and blowing the mixture into a core box to achieve a packing density of about 1.7 g/cc. The analysis system 25 was initiated to collect data at a sampling rate of about 1 sample per second to determine the background room air hydrocarbon value (see A). While data was being collected, air was passed through the filled core box at a rate of about 9.8 liters per minute. The non-dispersive infrared instrument and custom sampling system detected the hydrocarbon background in the room to be in the range of 8–10 parts per million as propane. The analysis system also detected the effluent from the uncured resin to be in the range of 20–30 ppm as propane (see A-1). The spike at 17 seconds (see B) is due to the sampling line being initially turned on at the core box. Amine catalyst was injected into the core box at about 93 seconds and was detected immediately by the analysis system (see C). About one microliter of triethylamine was injected into the carrier gas at a position upstream from the core box. The analysis system registered a propane concentration of about 295 ppm at C. The data collection continued for a total time of about 5 minutes. As the core box was purged with catalyst gas, a decrease in the amine catalyst was detected in the effluent with time. Purging of the core box and the amine effluent line was continued until levels of uncured resin in the range of 20–30 parts per million were obtained (see E) and further continued until room air background levels of around 8–10 parts per million hydrocarbon were obtained (see F). This took approximately 200 and 240 seconds, respectively. It should be noted that triethylamine concentration is converted to a concentration as parts per million hydrocarbon by the analysis system for simplicity. The plot of such data collection will shift depending upon the amount of resin-cured sand that is utilized and the amount of amine gas that is injected into the carrier gas stream. For example, if the amount of resin cured sand is increased to three times that utilized for the data of FIG. 2 and the amine gas injected is increased five fold over that utilized for such data of FIG. 2, region B will increase to about 384 ppm at region B when hydrocarbon in the effluent is detected, to about 80 ppm for background propane and region C will increase to about 850 ppm hydrocarbon as propane when the amine catalyst is injected and purge begins. Again, a decrease in the amine concentration, as the effluent line is purged, will track essentially the same curvature as that shown in FIG. 2 but to levels of about 75 ppm for region E and about 50 ppm for region F.

Figure 2:
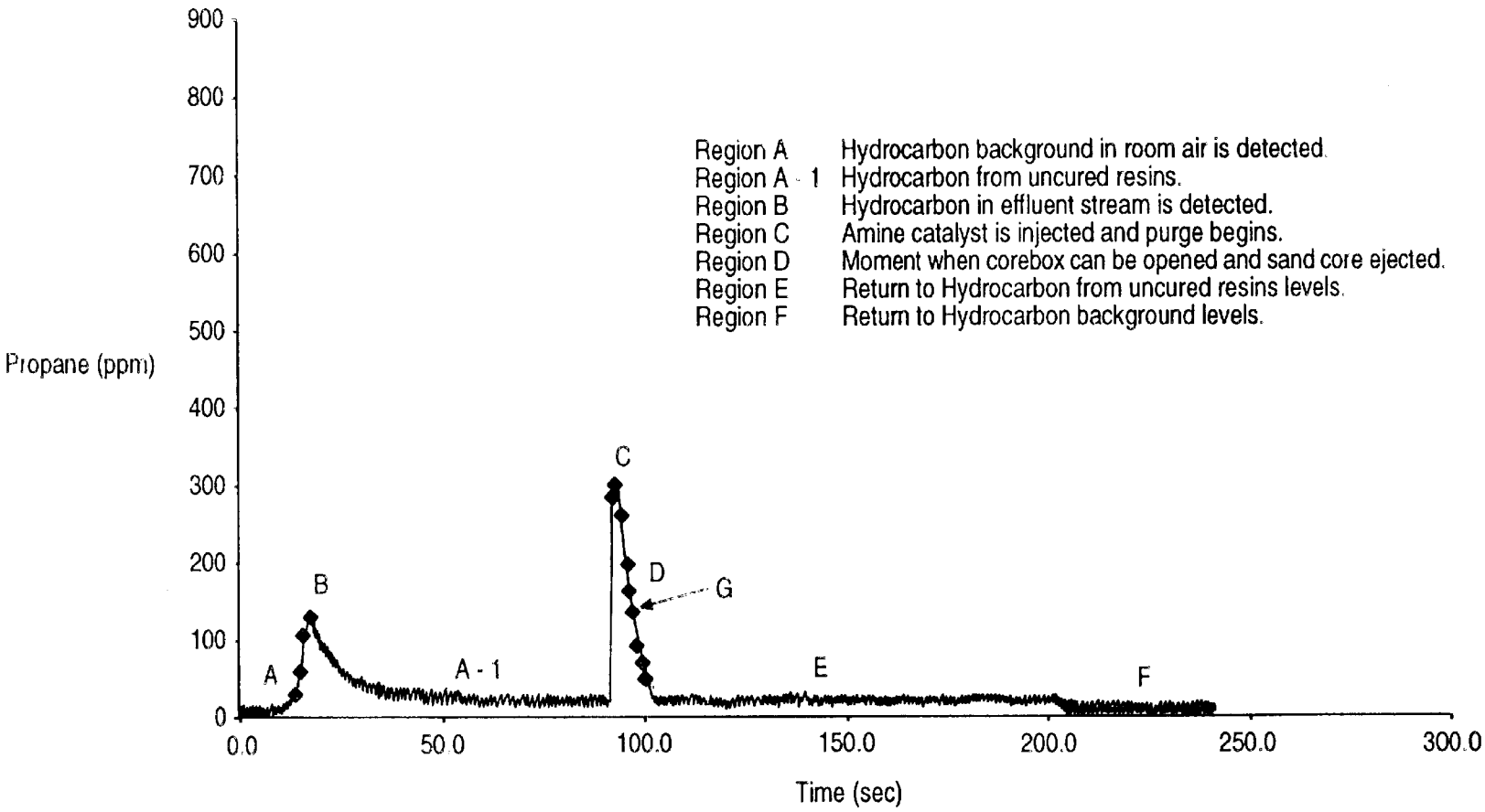
FIG. 2 is a graphical illustration of real time measuring data gathered by the non-dispersive infrared spectroscopy system equipment, illustrating gas concentration as a function of time in the core box.

The important part is that when the hydrocarbon or nitrogen-carbon bond concentration recedes to a level either at or equivalent to the level of uncured hydrocarbon prior to the injection of amine, or more conservatively to the level equivalent to the background hydrocarbons or any amount therebetween, the core box may be opened, such as at region D as shown in FIG. 2. Region D is where the net energy after the effluent has been subjected to absorption in the cell and the analysis system has subtracted the known background hydrocarbon level as well any unreacted hydrocarbon level to render a signal proportional to the amount of amine flowing out of the outlet box of the core box. If this net energy is at or below the background in unreacted hydrocarbon levels, the core box can be opened. This will ensure that a high and uniform concentration of the amine catalyst was present and has done its job.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A method of making a catalyst cured resin-coated sand core in which said resin-coated sand has been blown into a core box to define an uncured core with a desired packing density, the core box having at least one inlet to permit ingress of gases and at least one outlet to permit egress of only gases, comprising the steps of:

(a) passing a non-catalyzing gas through the defined sand core in the core box to create a first effluent and measuring the hydrocarbon content in such first effluent that was exposed to the uncured resin of the sand core;

(b) injecting a catalyst carrying gas into the at least one inlet to pass through the defined sand core within the core box for polymerizing the resin and thence exit from the at least one outlet as a second effluent; and (c) continuously measuring the hydrocarbon content of the second effluent, and when the hydrocarbon content decreases to approximately the hydrocarbon content of the first effluent, opening said core box to remove the sand core in a consistently cured condition.

2. The method as in claim 1, in which said measuring of step (c) is carried out by a non-dispersive infrared spectroscopy system in which an infrared light source is filtered using hydrocarbon and nitrogen-carbon bond filters, the system electronically converting a sensed energy after being filtered to represent the catalyst concentration.

3. The method as in claim 1, in which said non-catalyzing gas is air or nitrogen, and said catalyst carrying gas is nitrogen containing triethylamine.

4. The method as in claim 1, in which said non-catalyzing gas passes through the defined sand core at a pressure of about 80 psi and said catalyst carrying gas passes through the defined sand core at a pressure of 20 psi, to provide a catalyst gas flow rate through the defined sand core at about 8–10 liters per minute.

5. The method as in claim 1, in which the time interval between the initiation of step (b) and the time at which the core box may be safely and satisfactorily opened is less than 10 seconds.

6. The method as in claim 1, in which the total cycle time for the catalyst curing cycle is less than two minutes utilizing the method herein.

* * * * *